US005418078A

United States Patent [19]

Desie et al.

[11] Patent Number: 5,418,078

[45] Date of Patent: May 23, 1995

[54] INK RECEIVING LAYERS

[75] Inventors: Guido Desie, Herent; Eric Verschueren, Merksplas; Luc Lemmens, Lint, all of Belgium

[73] Assignee: Agfa-Gevaert, N.V., Mortsel, Belgium

[21] Appl. No.: 184,476

[22] Filed: Jan. 21, 1994

[30] Foreign Application Priority Data

Feb. 1, 1993 [EP] European Pat. Off. ..... 93200250

[51] Int. Cl.[6] ..... B41M 5/00

[52] U.S. Cl. ..... 428/704; 428/195; 428/500

[58] Field of Search ..... 428/195, 411.1, 913, 428/914, 520, 704, 500

[56] References Cited

U.S. PATENT DOCUMENTS 5,254,403 10/1993 Malhotra ..... 428/323

*Primary Examiner*—Pamela R. Schwartz

*Attorney, Agent, or Firm*—Breiner & Breiner

[57] ABSTRACT

An ink-jet recording element is provided comprising a polymeric film substrate or a resin coated paper substrate and at least one ink-receiving layer coated thereon comprising at least one binder and at least one mordanting agent characterized in that said mordanting agent comprises a polymer containing a phosphonium moiety. Preferably said mordanting agent consists of a copolymer of ethylenically unsaturated monomers containing a phosphonium moiety co-polymerized with N-vinyl imidazole or 2-methyl-2-vinyl imidazole and optionally other co-polymerizable monomers or of a mixture of from 5 to 70% by weight, of a polymer containing a phosphonium moiety, and obtained by homo- or co-polymerization of ethylenically unsaturated monomers and from 30 to 95% by weight, of a second polymer, which is free from cationic groups and has been obtained by homo- or co-polymerization of N-vinyl imidazole or 2-methyl-2-vinyl imidazole and optionally other co-polymerizable monomers.

6 Claims, No Drawings

INK RECEIVING LAYERS

FIELD OF THE INVENTION

This invention relates to ink-jet recording elements that contain a polymeric substrate on which are coated ink-receptive layers that can be imaged by the application of liquid ink dots (e.g. by ink-jet printers).

BACKGROUND OF THE INVENTION

Polymeric substrates are becoming more important in the manufacture of ink-receiving elements for ink-jet printing (e.g. resin coated paper, polyesterfilm, etc). One of the applications of ink-jet recording elements on a polymeric substrate for ink-jet printing is the production of transparencies. These elements are primarily intended for use on an overhead projector. More generally, these elements can be used for all kinds of viewing means by transmitted light. Such a transparency for overhead projection can easily be created by applying liquid ink dots to the ink-receptive layer using equipment such as ink jet printers.

In the ink jet printing technique the individual ink droplets can be applied to the receiving substrate in several different ways. The ink solution can be jetted continuously through a small nozzle towards the receiving layer (Hertz method). The ink droplet can also be created "upon demand" by a piezoelectric transducer or a thermal push (Bubble Jet).

It is known that the ink-receptive layers in transparent ink-jet recording elements must meet different stringent requirements:

- The ink-receiving layer should have a high ink absorbing capacity, so that the dots will not flow out and will not be expanded more than is necessary to abtain a high optical density, even if ink droplet in a multi-color system may be superposed on the same physical spot.
- The ink-receiving layer should have a high ink absorbing speed (short ink drying time) so that the ink droplets will not feather if smeared immediately after applying.
- The ink-receiving layer should be excellent in color forming characteristics.
- The ink dots that are applied to the ink-receiving layer should be smooth at their peripheries and have a shape of a true sphere. The dot diameter must be constant and accurately controlled.
- The ink-receiving layer must be readily wetted so that there is no "puddling", i.e. coalescence of adjacent ink dots, and an earlier absorbed ink drop should not show any "bleeding", i.e. overlap with neighbouring or later placed dots.
- The ink-jet recording element must have a low haze-value and be excellent in transmittance properties.
- After being printed the image must have a good resistance regarding waterfastness, lightfastness and indoor-discoloration.
- The ink-jet recording element may not show any curl or sticky behaviour if stacked before or after being printed.

To meet these requirements, the ink receptive layers of the prior art have been prepared for a long time using many different materials. A dimensionally stable substrate such as polyethyleneterephtalate (PET), cellulosetriacetate, or paper is used most frequently and coated with one or more polymer coatings. These receiving polymer coatings comprise one or more binders and different additives which are necessary to meet the requirements mentioned above.

In the German Patent Application DE 2,234,823 an ink receiving layer comprising gelatin and different particulates and colour molecules is described. U.S. Pat. No. 3,889,270 describes an ink-receiving layer comprising a molecular or colloidal disperse phase that enables the jetting ink to penetrate a few microns into this layer. The binder (gelatin, albumin, casein, proteins, polysaccharide, cellulose and its derivatives, (copolymers of) polyvinylalcohol is combined with hydrophylic silica and a white toner.

U.S. Pat. No. 4,503,111 describes an ink-receiving layer where a first binder (gelatin or polyvinylalcohol (PVA)) is mixed with a polyvinylpyrrolidone (PVP) having a molecular weight of at least 90000, and for which the ratio PVA/PVP is in the range 3:1 to 1:3.

This mixture of PVA, PVP or copolymers can also be combined with a coalesced latex of co-PVA-Polyvinylbenzylammoniumchloride (U.S. Pat. No. 4,547,405) yielding a further improvement in waterfastness.

An additional improvement in maximum density and drying time can be obtained using particulates in the binder. Many patent applications have described this effect for many different binder-systems. U.S. Pat. No. 3,357,846 describes pigments such as kaolin, talc, bariet, TiO2 used in starch and PVA. U.S. Pat. No. 3,889,270 describes silica in gelatin, PVA and cellulose. Pigments and particles have also been described in patent applications DE 2,925,769, GB 2,050,866, U.S. Pat. No. 4,474,850, U.S. Pat. No. 4,547,405, U.S. Pat. No. 4,578,285, WO 88 06532, U.S. Pat. No. 4,849,286, EP 339 604, EP 400 681, EP 407 881, EP 411 638 and US 5,045,864.

In many patent applications the tuning of the surface energy and polarity of the receiving layer is done by the use of special (fluoro) tensides: e.g. U.S. Pat. No. 4,578,285, U.S. Pat. No. 4,781,985 and U.S. Pat. No. 5,045,864.

The drying time characteristic can also be improved by a better tuning of the pH value of the coating solution, as described in unpublished European Application 92 203316.2

An improvement in waterfastness is mostly realised by the use of ammonium mordanting polymers. These polymers interact with most typical ink jet inks resulting in a better localisation of the dye in the binder. Typical examples of such descriptions are U.S. Pat. Nos. 4,371,582, 4,575,465, 4,649,064, GB 2,210,071 and EP 423 829. For instance in U.S. Pat. No. 4,371,582 a basic polymer latex comprising tertamino- or quaternary ammonium groups is described. In U.S. Pat. No. 4,575,465 an ink-receiving layer comprising a hydrophilic polymer with up to 50% by weight of vinylpyridine/vinylbenzylquaternary ammonium salt copolymers is claimed. In U.S. Pat. No. 4,649,064 the quaternary ammonium derivatives are used in combination with calciumacetate, a binder, a suitable crosslinker for the binder, and an ink composition comprising a binder and a crosslinkable dye.

Unfortunately, these transparent ink-jet recording elements with ink-receiving layers that have been described in the prior art fail to combine a short drying time with an excellent waterfastness, especially when the layers are printed with conventional non reactive, water based inks.

OBJECT AND SUMMARY OF THE INVENTION

It is an object of the invention to provide an ink-jet recording element that comprises a polymeric film or a resin coated paper as a support and an ink-receptive layer coated thereon in which the element is adapted for use in a printing process where liquid ink dots are applied to it with a high resolution, where the element can be printed by a conventional ink jet ink, resulting in a printed image with both a short drying time and an excellent waterfastness. Other objects and advantages of the present invention will become clear from the detailed description following herinafter.

According to this invention the above object(s) is (are) realized by providing an ink-jet recording element comprising a polymeric film substrate or a resin coated paper substrate and at least one ink-receiving layer coated thereon comprising at least one binder and at least one mordanting agent characterised in that said mordanting agent is a polymer containing a phosphonium moiety.

DETAILED DESCRIPTION OF THE INVENTION

The present invention is based upon the discovery that phosphonium mordanting polymers have an advantage over widely known ammonium mordanting polymers if used as an additive to the binder of an ink-jet recording element used for the ink-jet printing technique.

In the photographic art the use of phosphonium mordanting agents has been described (DE 3,109,931; U.S. Pat. No. 4,585,724; EP 295 338; EP 306 564). In most instances an improvement in lightfastness has been reported (e.g. in the diffusion transfer photographic imaging).

In a preferred embodiment of this invention a copolymer of ethylenically unsaturated monomers containing a phosphonium moiety, co-polymerised with N-vinyl imidazole or 2-methyl-2-vinyl imidazole and optionally other co-polymerisable monomers can be used as mordanting agent in the ink-receiving layer. In a further preferred embodiment a mixture of from 5 to 70% by weight, of a first polymer containing the phosphonium moiety, and obtained by homo- or copolymerisation of ethylenically unsaturated monomers and from 30 to 95% by weight, of a second polymer, which is free from cationic groups and has been obtained by homo- or co-polymerisation of N-vinyl imidazole or 2-methyl-2-vinyl imidazole and optionally other co-polymerisable monomers, as described in U.S. Pat. No. 4,585,724 is used as mordanting agent in the present invention.

Most preferred mordanting ingredients for the ink-receiving layers according to this invention, are phosphonium mordanting polymers, comprising as recurring groups

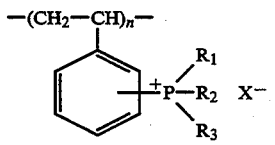

wherein each of $R_1$, $R_2$ and $R_3$ which may be the same or different are C1–C8 alkyl-, cycloalkyl- or aryl-group and wherein n is an integer from 1 to 12, as described in EP 295 338 and EP 306 564.

The ink-receptive layers in the novel transparent ink-jet recording elements according to this invention contain at least one phosphonium mordanting polymer in at least one compatible binder which may be selected from the group consisting of: (1) hydroxyethyl cellulose; (2) hydroxypropyl cellulose; (3) hydroxyethylmethyl cellulose; (4) hydroxypropyl methyl cellulose; (5) hydroxybutylmethyl cellulose; (6) methyl cellulose; (7) sodium carboxymethyl cellulose; (8) sodium carboxymethylhydroxethyl cellulose; (9) water soluble ethylhydroxyethyl cellulose; (10) cellulose sulfate; (11) polyvinyl alcohol; (12) polyvinyl acetate; (13) polyvinylacetal; (14) polyvinyl pyrrolidone; (15) polyacrylamide; (16) acrylamide/acrylic acid copolymer; (17) styrene/acrylic acid copolymer; (18) ethylene-vinylacetate copolymer; (19) vinylmethyl ether/maleic acid copolymer; (20) poly(2-acrylamido-2-methyl propane sulfonic acid); (21) poly(diethylene triamine-co-adipic acid); (22) polyvinyl pyridine; (23) polyvinyl imidazole; (24) polyimidazoline quaternized; (25) polyethylene imine epichlorohydrinmodified; (26) polyethylene imine ethoxylated; (27) poly (N,N-dimethyl-3,5-dimethylene piperidinium chloride; (28) polyethylene oxide; (29) polyurethane; (30) melamin resins; (31) epoxy resins; (32) urea resins; (33) styrene-butadiene rubbers; (34) chloroprene rubbers; (35) nitrile rubbers; (36) gelatin; (37) carrageenan; (38) dextran; (39) gum arabic; (40) casein; (41) pectin; (42) albumin; (43) starch; (44) collagen derivatives; (45) collodion and (46) agar-agar.

The ink receiving layer coatings according to the present invention may also be:

i. binary blends comprised of from about 10 to about 90 percent by weight of polyethylene oxide or gelatine and from about 90 to about 10 percent by weight of an other component selected from the group mentionned above.

ii. ternary blends comprised of from about 10 to about 50 percent by weight of polyethylene oxide from about 85 to about 5 percent by weight of sodium carboxymethyl cellulose and from about 5 to about 45 percent by weight of an other component selected from the group mentionned above.

iii. ternary blends comprising of from about 10 to about 50 percent by weight of gelatin, from about 85 to about 5 percent by weight of sodium carboxymethyl cellulose and from about 5 to about 45 percent by weight of a component selected from the group mentionned above.

iv. ternary blends comprised of from about 10 to about 50 percent by weight of gelatin, from about 85 to about 5 percent by weight of polyvinyl pyrrolidone and from about 5 to about 45 percent by weight of an other component selected from the group mentionned above.

Preferred binary blends of binders for the ink receiving layers according to this invention are:

hydroxyethylmethyl cellulose, 75 percent by weight, and polyethylene oxide, 25 percent by weight;

gelatin, 80 percent by weight and polyethylene oxide, 20 percent by weight;

gelatin, 70 percent by weight, and polyvinyl pyrrolidone, 30 percent by weight;

gelatin, 80 percent by weight, and polyvinylalcohol, 20 percent by weight;

sodium carboxymethyl cellulose, 80 percent by weight, and gelatin, 20 percent by weight.

Preferred ternary blends of binder materials for coating the ink receiving layers according to this invention are:

gelatin, 50 percent by weight, sodium carboxymethyl cellulose, 25 percent by weight, and polyethylene oxide, 25 percent by weight;

gelatin, 60 percent by weight, polyvinyl pyrrolidone, 20 percent by weight, and polyvinyl alcohol, 20 percent by weight;

gelatin, 50 percent by weight, polyvinyl pyrrolidone, 25 percent by weight, and sodium carboxymethyl cellulose, 25 percent by weight.

Preferred binders are gelatin, vinylpyrrolidone and polyvinylalcohol or binary or ternary blends of these. Gelatin is thus a particularly preferred material for use in forming the ink-receiving layer of materials according to this invention. Among the reasons is the fact that it forms a clear coating, is readily cross-linked in an easily controllable manner, and is highly absorptive of water-based liquid inks to thereby provide rapid-drying characteristics.

The ink-receiving layer according to this invention is preferably cross-linked to provide such desired features as waterfastness and non-blocking characteristics. The cross-linking is also useful in providing abrasion resistance and resistance to the formation of fingerprints on the element as a result of handling. There are a vast number of known cross-linking—agents also known as hardening agents—that will function to cross-link film forming materials, and they are commonly used in the photographic industry to harden gelatin emulsion layers and other layers of photographic silverhalide elements.

Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulfonate esters, active halogen compounds, s-triazines and diazines, epoxides, active olefins having two or more active bonds, active olefins, carbodiimides, isoxazolium salts unsubsituted in the 3-position, esters of 2-alkoxy-N-carboxy-dihydroquinoline, N-carbamoyl and N-carbamoylpyridinium salts, hardeners of mixed function, such as halogen-substituted aldehyde acids (e.g. mucochloric and mucobromic acids), onium substituted acroleins and vinyl sulfones and polymeric hardeners, such as dialdehyde starches and copoly (acroleinmethacrylic acid).

The ink-receptive layer in the novel ink-jet recording elements according to this invention may also comprise particulate material, which may consist either of primary particles comprising single particles or of porous particles comprising secondary particles formed from aggregation of the primary particles. Among these particulate materials, particularly preferrable are porous particles having an average particle size of 1–30 μm, preferably 3–10 μm which can be formed by aggregation of smaller particles, having a size of 0.01 to 2 μm, preferably 0.1 to 0.5 μm. These porous particles formed by secondary or tertiary aggregation will not easily disintegrate. The porous material is preferably made of at least one of the organic materials such as polystyrene, polymethacrylate, polymethylmethacrylate, elastomers, ethylene-vinyl acetate copolymers, polyesters, polyester-copolymers, polyacrylates polyvinylethers, polyamides, polyolefines, polysilicones, guanamine resins, polytetrafluoroethylenes, elastomeric styrene-butadiene rubber (SBR), elastomeric butadiene-acrylonitrile rubber (NBR), urea resins, urea-formalin resins, etc., or inorganic materials such as synthetic silica, talc, clay, koalin, diatomaceous earth, calcium carbonate, magnesium carbonate, aluminium hydroxide, aluminium oxide, titanium oxide, zinc oxide, barium sulfate, calcium sulfate, zinc sulfide, satin white, aluminium silicate, calcium silicate, lithopone, etc. The specific surface area of the particulate material may vary from 10 to 200 $m^2/g$ (BET specific surface), and the oil absorption index may range from $5\ 10^{-6}$ to $3.5\ 10^{-5}\ ms^{-\frac{1}{2}}$.

Polymethylmethacrylate beads may be added as matting agents. They are usually added to the receptive layer in a range of 0.4 to 1.2 $g/m^2$ and preferably in a range of 0.40 to 0.90 $g/m^2$ with 0.50 $g/m^2$ being most preferred.

When the element is intended for viewing in reflection, the ink-receiving layer of the invention may contain a whitening agent. $TiO_2$ (rutile or anatase) is preferably used as whitening agent in an amount sufficient to produce in the film element a transmission density to white light of at least 0.05, and preferably 0.3 or higher. Amounts of whitener present in the film element can range from 0.1 to 2.0 $g/m^2$, and preferably from 0.2 to 0.5 $g/m^2$, and most preferably 0.3 $g/m^2$. A slurry of the whitener may be added by batchwise addition or by in-line injection just prior to coating the receptor layer(s) on the support.

The ink-receiving layer of the present invention can also comprise a plasticizer such as ethylene glycol, dietylene glycol, propylene glycol, polyethylene glycol, glycerol monomethylether, glycerol monochlorohydrin, ethylene carbonate, propylene carbonate, tetrachlorophthalic anhydride, tetrabromophthalicanhydride, urea phosphate, triphenylphosphate, glycerolmonostearate, propylene glycol monostearate, tetramethylene sulfone, n-methyl-2-pyrrolidone, n-vinyl-2-pyrrolidone, and polymer latices with low Tg-value such as polyethylacrylate, polymethylacrylate, etc.

Surfactants may be incorporated in the ink-receptive layer of the present invention. They can be any of the cationic, anionic, amphoteric, and nonionic ones as described in JP-62-280068 (1987). Examples of the surfactants are soap, N-alkylamino acid salts, alkylether carboxylic acid salts, acylated peptides, alkylsulfonic acid salts, alkylbenzene and alkylnaphthalene sulfonic acid salts, sulfosuccinic acid salts, a-olefin sulfonic acid salts, N-acylsulfonic acid salts, sulfonated oils, alkylsulfonic acid salts, alkylether sulfonic acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed acid salts, alkylallylethersulfonic acid salts, alkylamidesulfonic acid salts, alkylphosphoric acid salts, alkyletherphosphoric acid salts, alkylallyletherphosphoric acid salts, alkyl and alkylallylpolyoxyethylene ethers, alkylallylformaldehyde condensed polyoxyethylene ethers, blocked polymers having polyoxypropylene, polyoxyethylene polyoxypropylalkylethers, polyoxyethyleneether of glycolesters, polyoxyethyleneether of sorbitanesters, polyoxyethyleneether of sorbitolesters, polyethyleneglycol aliphatic acid esters, glycerol esters, sorbitane esters, propyleneglycol esters, sugaresters, fluoro C2–C10 alkylcarboxylic acids, disodium N-perfluorooctanesulfonyl glutamate, sodium 3-(fluoro-C6-C11alkyloxy)-1-C3–C4 alkyl sulfonates, sodium 3-(ω-fluoro-C6–C8 alkanoyl-N-ethylamino)-1-propane sulfonates, N-[3-(perfluorooctanesulfonamide)propyl]-N,N-dimethyl-N-carboxymethylene ammonium betaine, fluoro-C11-C20 alkylcarboxylic acids, perfluoro C7–C13 alkyl carboxylic acids, perfluorooctane sulfonic acid diethanolamide, Li K and Na perfluoro C4–C12 alkyl sulfonates, N-propyl-N-(2-hydroxyethyl)perfluorooctane sulfonamide, perfluoro C6–C10 alkylsulfonamide propyl sulfonyl glycinates, bis-(N-perfluorooctylsulfonyl-N-ethanolaminoethyl)phosphonate, mono-perfluoro C6–C16 alkyl-ethyl phosphonates, and perfluoroalkylbetaine. Especially useful are the fluorocarbon surfactants as described in e.g. U.S. Pat. No. 4,781,985, having a structure of:

$F(CF_2)_{4-9}CH_2CH_2SCH_2CH_2N^+R_3X^-$ wherein R is an hydrogen or an alkyl-group; and in U.S. Pat. No. 5,084,340, having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms. These surfactants are commercially available from DuPont and 3M. The concentration of the surfactant component in the ink-receptive layer is typically in the range of 0.1 to 2 percent, preferably in the range of 0.4 to 1.5 percent and is most preferably 0.75 percent by weight based on the total dry weight of the layer.

The ink-receiving layers of the present invention may additionally comprise different additives which are well known in the art, and include UV-filters and antistatic agents.

The ink-receiving layers of the present invention may be coated on one side of the support either as a single layer or may be divided into two or more distinct layers, coated from the same or different coating solutions. When preparing an ink-jet recording element according to this invention, by coating two or more ink-receing layers onto a support, it is possible to prepare an ink-recording element with excellent properties, especially with respect to ink absorbency and waterfastness, when at least one of said distinct ink-receiving layers comprises a mordanting agent which is a polymer containing a phosphonium moiety according to the present invention. When preparing an ink-jet recording element according to the present invention, by coating two or more ink-receing layers onto a support, said mordanting agent which is a polymer containing a phosphonium moiety is preferably comprised in the ink-receiving layer that is located as far as possible from the support.

The ink-jet recording elements of this invention comprise a polymeric, either opaque or transparent, support for the ink-receptive layer. A wide variety of such supports are known and are commonly employed in the art. They include, for example, transparent supports as those used in the manufacture of photographic films including cellulose acetate propionate or cellulose acetate butyrate, polyesters such as poly(ethyleneterephthalate), polyamides, polycarbonates, polyimides, polyolefins, poly(vinylacetals), polyethers and polysulfonamides. Other examples of useful high-quality polymeric supports for the present invention include opaque white polyesters and extrusion blends of poly(ethylenenterephthalate) and polypropyleen. Polyester film supports and especially poly(ethyleneterephthalate) are preferred because of their excellent properties of dimensional stability. When such a polyester is used as the support material, a subbing layer must be employed to improve the bonding of the ink-receptive layer to the support. Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The ink-jet recording elements of this invention are employed in printing processes where liquid ink dots are applied to the ink-receiving layer of the element. A typical process is a ink-jet printing process which involves a method of forming the image on a paper or transparency by ejecting ink droplets from a print head from one or more nozzles. Several schemes can be used to control the deposition of the ink droplets on the image-recording element to form the desired ink dot pattern used to build the image. For example, one method comprises deflecting electrically charged ink droplets by electrostatic means. Another method comprises the ejection of single droplets "upon demand" under the control of a piezoelectric device which can operate by volume change or "wall" motion, or under the control of a thermal excitation.

The inks used to image the ink-jet recording elements of this invention are well known to those skilled in the art. The ink compositions used in such printing processes as ink-jet printing are typically liquid compositions comprising a solvent or carrier liquid, dyes or pigments, humectants, organic solvents, detergents, thickeners, preservatives, etc. The solvent or carrier liquid is predominantly water, although ink in which organic materials such as polyhydric alcohols are used as carrier liquid, can also be used. The dyes used in such ink-jet ink compositions are typically water-soluble direct dyes or acid type dyes. Such liquid ink compositions have been extensively described in the prior art (U.S. Pat. Nos. 4,381,946, 4,781,758, 4,994,110).

The following examples are presented to illustrate this invention, but not to limit the present invention thereto.

EXAMPLE 1

A polyethylene terephthalate film (PET-100 μm thick with typical photographic subbing layers, used for a better bonding between the PET and the gelatinous layers) was used as the substrate. The composition A was applied to this substrate with a pilot coating machine, so as to give a dry film-coating thickness of 5 μm; chilled at 5° C. for 20 s; and dried at 35° C. for 120 s (RH=30%).

Coating solution A 70 parts of a gelatin with a gel strength higher than 220 g, the viscosity of a 10% solution of it at 40° C. being higher than 50 mPas and containing 25 to 30 % microgels were mixed with 7 parts Co(acrylonitrile-vinylimidazole-vinylbenzyl-tri-N-butylphosphonium-chloride) commercially available through Hoechst AG, Germany under tradename POLYFOS and with 0.25 parts of diisooctylsulfosuccinate commercially available through American Cyanamid Co under tradename AEROSOL OT 75. Water was added to give 1000 parts. The pH of the coating solution was adjusted to pH 6 by the addition of a sodium hydroxyde solution.

COMPARATIVE EXAMPLE 1

An ink-jet recording medium with an ink-receiving transparent layer was prepared as described in example 1, except for the fact that no phosphonium polymer was added to the coating solution.

EXAMPLE 2

An ink-jet recording medium with an ink-receiving transparent layer was prepared as described in example 1, except for the fact that coating solution B was used instead of coating solution A.

Coating solution B 60 parts of a gelatin with a gel strength higher than 220 g, the viscosity of a 10% solution of it at 40° C. being higher than 50 mPas and containing 25 to 30 % microgels were mixed with 7 parts Co-(acrylonitrile-vinylimidazole-vinylbenzyl-tri-N-butylphosphonium-chloride) commercially available through the Hoechst company of Germany under tradename POLYFOS , with 22 parts of silicagel* and with 0.25 parts of diisooctylsulfosuccinate commercially available through American Cyanamid Co under tradename AEROSOL OT 75. Water was added to give 1000 parts. The pH of the coating solution was adjusted to pH 6 by the addition of a sodium hydroxyde solution. Silicagel: KIESELSOL 300F, a tradename of Bayer AG, Leverkusen Germany for a dispersion of $SiO_2$ with a specific surface of 280 to 300 $m^2/g$.

EXAMPLE 3

An ink-jet recording medium with an ink-receiving transparent layer was prepared as described in example 1, except for the fact that coating solution C was used instead of coating solution A.

Coating solution C 60 parts of a gelatin with a gel strength higher than 220 g, the viscosity of a 10% solution of it at 40° C. being higher than 50 mPas and containing 25 to 30% microgels were mixed with 7 parts Co-(acrylonitrile-vinylimidazole-vinylbenzyl-tri-N-butylphosphonium-chloride) commercially available through Hoechst AG, Germany under tradename POLYFOS, with 0.6 parts of formaldehyde and with 0.9 parts of a fluorosurfactant, with formula $C_7F_{15}COONH_4$ (FC126 a commercial product of MMM, Minesota, U.S.A.). Water was added to give 1000 parts. The pH of the coating solution was adjusted to pH 6 by the addition of a sodium hydroxyde solution.

EXAMPLE 4

An ink-jet recording medium with an ink-receiving transparent layer was prepared as described in example 1, except for the fact that coating solution D was used instead of coating solution A.

Coating solution D 60 parts of a gelatin with a gel strength higher than 220 g, the viscosity of a 10% solution of it at 40° C. being higher than 50 mPas and containing 25 to 30% microgels were mixed with 12 parts Polyvinylpyrrolidone (LUVISKOL K90, a tradename for polyvinylpyrrolidone with MW 630,000 of BASF, AG , Germany), 7 parts Co-(acrylonitrile-vinylimidazole-vinylbenzyl-tri-N-butylphosphonium-chloride) commercially available through the Hoechst company of Germany under tradename POLYFOS and with 0.25 parts of diisooctylsulfosuccinate commercially available through American Cyanamid Co under tradename AEROSOL OT 75. Water was added to give 1000 parts. The pH of the coating solution was adjusted to pH 6 by the addition of a sodium hydroxyde solution.

COMPARATIVE EXAMPLE 2

An ink-jet recording medium with an ink-receiving transparent layer was prepared as described in example 1, except for the fact that coating solution E was used instead of coating solution A.

Coating solution E 60 parts of a gelatin with a gel strength higher than 220 g, the viscosity of a 10% solution of it at 40° C. being higher than 50 mPas and containing 25 to 30% microgels were mixed with 7 parts of Co(N-vinyl-N'-(3,4-dichlorobenzyl)-imidazolium chloride, N-vinymimidazole and with 0.25 parts of diisooctylsulfosuccinate commercially available through American Cyanamid Co under tradename AEROSOL OT 75. Water was added to give 1000 parts. The pH of the coating solution was adjusted to pH 6 by the addition of a sodium hydroxyde solution.

Before using the ink-jet recording media from examples 1 to 4 and of comparative examples 1 and 2, the ink-jet recording media were first acclimatised for at least 2 hours at 25° C. and 30% RH, and then a test image was jetted upon it. For the ink application, a Hewlett-Packard DeskJet 500C was used.

The prints on the ink-jet recording media prepared in this way were evaluated as follows:

1. The optical density (OD) of the three primary colors and black was measured by means of a Macbeth TR-1224 optical densitometer. All measurements for this transparent material were done in transparent mode.
2. The ink absorbency was evaluated as follows: a printout with several primary colors and black was made, so that there is a big time lap between the different blocks of the colors used. Immediately after finishing this print, a sandwich was made with a conventional Xerographic paper, the sandwich was conducted through a roller pair with constant pressure. After removal of the transparent material the optical density on the paper substrate was measured with a Macbeth TR-1224 optical densitometer. The optical density as a function of block number, i.e. as a function of time, was recorded. From these values a "decay time" was calculated. In table 1 the values for ink-absorbency are expressed in second. The smaller that value the better.
3. The dot quality was measured by image analysis of a microscopic view of a printed example with a few droplets. Both the surface and the contour quality were determined. The observed quality was scaled between 1 (very good) and 5 (very bad);
4. The lateral diffusion was tested by printing blocks of primary colors and looking at the boundary for the appearance of secondary colors, for instance, the amount of green color that could be observed between a yellow and a cyan block was evaluated between 1 (very good) and 5 (very bad).
5. The waterfastness was tested by first measuring the optical density of a printed sample with different primary colors and black; putting the sample in distilled water of 25° C. for 2, 5, 10 and 30 s; and after drying in the atmosphere measuring the optical density of the treated sample again. The slope of the plot optical density versus log(time in sec) is inversely related to the waterfastness. In table 1 and 2 the values for waterfastness are the average of the slopes of the optical density versus log(time in sec) plot for each of the three primary colors and black times 100.

6. The lightfastness was tested by first measuring the optical density of a printed sample with different primary colors and black; placing the sample under a Xenon-tube for 16 hours (Xe 1500; Color temperature=5500–6500K; 180 kLux; T<45° C.); and after this treatment measuring the optical density of the sample again. The remaining optical density is related to the lightfastness. In tables 1 and 2 the values for lightfastness are the remaining densities expressed as a percentage of the original density.
7. The sensitivity to fingerprints was evaluated by giving a value 1 (very good) to 5 (very bad) to samples that were treated manually and analysed visually.

The results of these evaluations are given in table 1.

TABLE 1

| Property | Example n° 1 | 2 | 3 | 4 | Comparative example n° 1 | 2 |
|---|---|---|---|---|---|---|
| OD_Y | 0.54 | 0.55 | 0.50 | 0.53 | 0.50 | 0.55 |
| OD_M | 0.53 | 0.56 | 0.51 | 0.55 | 0.49 | 0.50 |
| OD_C | 0.65 | 0.80 | 0.73 | 0.82 | 1.21 | 1.15 |
| OD_B | 0.70 | 0.68 | 0.67 | 0.72 | 0.74 | 0.78 |
| Ink absorbency | 376 | 216 | 298 | 297 | 488 | 716 |
| Dot quality | 1 | 1 | 1 | 2 | 3 | 2 |
| Lateral diffusion | 1 | 1 | 1 | 1 | 3 | 1 |
| Waterfastness | 31.75 | 31.25 | 35.25 | 19.5 | 322.0 | 16.25 |
| Lightfastness | 64 | 59 | 63 | 57 | 60 | 62 |
| Fingerprints | 2 | 2 | 1 | 2 | 3 | 3 |

The ink-receiving layers according to the present invention, examples 1 to 4, present better qualities than the ink-receiving layers according to the prior art (comparative examples 1 and 2), especially in respect of the ink absorbency.

EXAMPLE 5

A polyethylene terephthalate film (PET-100 μm thick with typical photographic subbing layers, used for a better bonding between the PET and the gelatinous layers) was used as the substrate.

On the substrate two distinct ink-receiving layers with different coating compositions (F and G) were coated by simultaneously applying to one side of the substrate a layer with coating composition F (wet coating thickness 100 μm) and a layer with coating composition G (wet coating thickness 90 μm) on a pilot coating machine with layer G being the outermost layer.

The coatings were chilled at 5° C. for 20 sec., dried at 35° C. for 280 sec. at 30% relative humidity, so as to give a dry film coating thickness of 6.7 μm for layer F and 3.3 μm for layer G.

This resulted in an ink-receiving element that comprised in both ink-receiving layers a polymer comprising phosphonium moieties.

Coating solution F 67 parts of a gelatin with a gel strength higher than 220 g, the viscosity of a 10% solution of it at 40° C. being higher than 50 mPas and containing 25 to 30% microgels were mixed with 7 parts Co-(acrylonitrile-vinylimidazole-vinylbenzyl-tri-N-butylphosphonium-chloride) commercially available through the Hoechst AG, Germany under tradename POLYFOS. Water was added to give 1000 parts. The pH of the coating solution was adjusted to pH 8 by the addition of a sodium hydroxyde solution.

Coating solution G 33 parts of a gelatin with a gel strength higher than 220 g, the viscosity of a 10% solution of it at 40° C. being higher than 50 mPas and containing 25 to 30% microgels were mixed with 3.7 parts Co-(acrylonitrile-vinylimidazole-vinylbenzyl-tri-N-butylphosphonium-chloride) commercially available through the Hoechst AG, Germany under tradename POLYFOS and with 0.20 parts of diisooctylsulfosuccinate commercially available through American Cyanamid Co under tradename AEROSOL OT 75. Water was added to give 1000 parts. The pH of the coating solution was adjusted to pH 8 by the addition of a sodium hydroxyde solution.

EXAMPLE 6

An ink-receiving layer was coated as described in Example 5, except for the fact that coating composition G, forming the outermost layer, did not contain a polymer comprising phosphonium moieties. This gave an ink-receiving recording element that contained only in the ink-receiving layer closest to the support a polymer comprising phosphonium moieties.

EXAMPLE 7

An ink-receiving layer was coated as described in Example 5, except for the fact that coating composition F, forming the layer closest to the support, did not contain a polymer comprising phosphonium moieties. This gave an ink-jet recording element layer that contained only in the outermost ink-receiving layer a polymer comprising phosphonium moieties.

COMPARATIVE EXAMPLE 3

An ink-receiving layer was coated as described in Example 5, except for the fact that neither coating composition G nor coating composition F did contain a polymer with a phosphonium moiety.

Before using the recording media from examples 5 and 6 and of comparative example 3, the recording media were first acclimatised for at least 2 hours at 25° C. and 30% RH, and then a test image was jetted upon it. For the ink application, a Hewlett-Packard DeskJet 500C was used.

The prints on the recording media prepared in this way were evaluated in the same manner as described for examples 1 to 4 and comparative examples 1 and 2. The results are given in table 2.

TABLE 2

| Property | Examples n° 5 | 6 | 7 | Comparative example n° 3 |
|---|---|---|---|---|
| OD_Y | 0.55 | 0.50 | 0.53 | 0.49 |
| OD_M | 0.50 | 0.53 | 0.53 | 0.48 |
| OD_C | 0.79 | 0.97 | 0.93 | 1.01 |
| OD_B | 0.69 | 0.71 | 0.70 | 0.70 |
| Ink absorbency | 172 | 208 | 180 | 230 |
| Dot quality | 1 | 2 | 2 | 3 |
| Lateral diffusion | 1 | 2 | 1 | 4 |
| Waterfastness | 1.75 | 65.75 | 24.5 | 185 |
| Lightfastness | 43 | 47 | 44 | 52 |
| Fingerprints | 3 | 2 | 3 | 3 |

We claim:

1. An ink-jet recording element comprising a polymeric film substrate or a resin coated paper substrate and at least one ink-receiving layer coated thereon comprising at least one binder and at least one polymer or copolymer containing a phosphonium moiety, as mordanting agent, wherein said polymer or copolymer containing a phosphonium moiety comprises as recurring groups

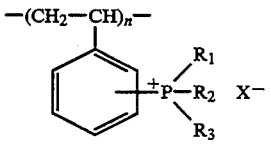

wherein each of $R_1$, $R_2$ and $R_3$ which may be the same or different are C1–C8 alkyl-, cycloalkyl- or aryl-group and wherein n is an integer from 1 to 12.

2. An ink-jet recording element according to claim 1, wherein said mordanting agent consists of a copolymer of ethylenically unsaturated monomers containing said phosphonium moiety, co-polymerized with N-vinyl imidazole or 2-methyl-2-vinyl imidazole and optionally other co-polymerizable monomers.

3. An ink-jet recording element according to claim 1, wherein said mordanting agent consists of a mixture of from 5 to 70% by weight, of said polymer or copolymer containing said phosphonium moiety, and obtained by homo- or co-polymerization of ethylenically unsaturated monomers and from 30 to 95% by weight, of a second polymer, which is free from cationic groups and has been obtained by either 1) homopolymerization of N-vinyl imidazole or 2-methyl-2-vinyl imidazole, or 2) copolymerization of N-vinyl imidazole and 2-methyl-2-vinyl imidazole.

4. An ink-jet recording element according to claim 1, wherein said ink-receiving layer(s) comprise(s) at least one binder selected from the group consisting of gelatin, polyvinyl pyrrolidone and polyvinyl alcohol.

5. An ink-jet recording element according to claim 1, wherein said element comprises two or more distinct ink-receiving layers and at least one of said layers comprising a polymer or copolymer containing said phosphonium moiety.

6. An ink-jet recording element according to claim 5, wherein said polymer or copolymer containing said phosphonium moiety is comprised in the ink-receiving layer farthest away from the support.

* * * * *